US005898644A

United States Patent [19]

Ganter et al.

[11] Patent Number: 5,898,644

[45] Date of Patent: Apr. 27, 1999

[54] RADIO-CONTROLLED TIMEPIECE MOVEMENT AND METHOD OF ASSEMBLY

[75] Inventors: Wolfgang Ganter, Eschbronn-Locherhof; Roland Maurer, Lauterbach, both of Germany

[73] Assignee: Junghans Uhren GmbH, Schramberg, Germany

[21] Appl. No.: 09/119,578

[22] Filed: Jul. 21, 1998

[30] Foreign Application Priority Data

Aug. 8, 1997 [DE] Germany ..... 297 14 186 U

[51] Int. Cl.[6] ..... G04C 11/02; G04C 9/00; G04B 37/00

[52] U.S. Cl. ..... 368/47; 368/88; 368/187

[58] Field of Search ..... 368/46, 47, 69–74, 368/76, 80, 185–187, 220, 223, 250, 256, 276, 278

[56] References Cited

U.S. PATENT DOCUMENTS 4,645,357 2/1987 Allgaier et al. .

5,231,612 7/1993 Allgaier et al. ..... 368/47

5,566,140 10/1996 Kohata et al. ..... 368/220

*Primary Examiner*—Vit Miska

*Attorney, Agent, or Firm*—Burns, Doane, Swecker & Mathis, L.L.P.

[57] ABSTRACT

A radio controlled timepiece movement includes a carrier structure and a wheel train mounted thereon. The wheel train includes a plurality of rotatable wheels each having a wheel aperture formed therein. The apertures are alignable with one another. A printed circuit board is mounted on the carrier structure and has a board aperture formed therethrough. An end of the board aperture disposed farthest from the wheels is covered by a portion of a conductor of the circuit board. A light beam transmitter is mounted on that conductor and disposed in the board aperture. A wire extends from the element to the second conductor. The transmitter and wire are embedded within a radiation-permeable material which fills the board aperture.

12 Claims, 2 Drawing Sheets

RADIO-CONTROLLED TIMEPIECE MOVEMENT AND METHOD OF ASSEMBLY

BACKGROUND OF THE INVENTION

The invention concerns a radio-controlled timepiece movement and method of assembly.

A radio-controlled timepiece movement is known from Allgaier et al. U.S. Pat. No. 4,645,357 (corresponding to DE 35 10 861). That movement includes a light-barrier for detecting the displayed time in order to implement an automatic correction either at the beginning of operation or during operation. The movement is distinguished by virtue of a compact structure and a high level of operational reliability because the light-barrier is integrated into the gear train of the movement itself. For the construction of a transmission-type light barrier arrangement, the 1ight barrier elements, i.e., a radiation transmitter and an opposing radiation receiver, are secured in through bores formed in a printed circuit board and a front housing wall of the movement, respectively.

Non-encased radiation transmitters in the form, for example, of diodes (in the form of chips) emitting infra-red light can also be glued in electrically conducting relationship directly onto a conductor track lining of the printed circuit board and electrically connected to another conductor track of the same printed circuit board by means of a bond wire which extends downwardly in an arc shape.

Then however that structure must be embedded in a radiation permeable plastic material, to provide for mechanical protection for same. It will be noted that overall this takes up a really large amount of space as the plastic material has to cover the high arc of the bond wire above the free surface of the chip down into the plane of the conductor track, and that results in both a wide and also a high mound of casting material. That is a nuisance, in particular, if the radio-controlled timepiece movement is to be of an extremely compact design configuration, for example so that it can be disposed in a wristwatch casing. The smaller the movement becomes, the correspondingly more complicated is the adjustment of the wheels which project into the light barrier arrangement, in terms of their respective angular position for transmitting light therethrough.

Therefore an object of the present invention is to develop a radio-controlled movement of the general kind set forth, that can be of a smaller design and more easily assembled.

SUMMARY OF THE INVENTION

In accordance with the invention the object is attained by a radio controlled timepiece movement which comprises a carrier structure, and a wheel train mounted on the carrier structure and including a plurality of wheels rotatable about a first axis. The wheels have respective wheel apertures which are alignable with one another along a second axis. A detector is provided for detecting positions of the wheels by establishing a light beam along the second axis which passes through the wheel apertures when those apertures are aligned along the second axis. The detector includes a light beam transmitting/receiving mechanism. A printed circuit board is mounted on the carrier structure and is oriented perpendicular to the first axis. The printed circuit board includes first and second sides facing respectively away from and toward the wheels. A board aperture is formed in the circuit board and extends from the first side to the second side to define the second axis. First and second conductors are mounted on the first and second sides, respectively. The first conductor covers a respective end of the board aperture.

An element of the transmitting/receiving mechanism is disposed in the board aperture and is mounted on a portion of the first conductor which covers the board aperture. A wire extends from the element to the second conductor.

The detector preferably comprises a light barrier element, more specifically a radiation transmitter, in the form of a chip placed with lateral play in the interior of the printed circuit board. The chip rests on a lining or foil which serves at the same time as a mechanical carrier, as an electrical connection and as a closure means for the printed circuit board aperture which accommodates the chip. By virtue of that arrangement the radiation transmitter at most projects slightly beyond the thickness of the printed circuit board so that there is only a flat or shallow arcuate configuration in regard to the bond wire to the printed circuit board lining. The height of the required mound of casting material is correspondingly lower; it is now also laterally of a particularly small dimension because it is now essentially limited to the printed circuit board aperture and the area immediately surrounding same, to the bond wire connection.

Desirably the wheel train is disposed in its own operable transmission block or unit which, only after it has been equipped with the wheels, is fitted on its two outside surfaces of the movement or carrier plate, which extend parallel to the wheels, with printed circuit boards for the light barrier elements (transmitter and receiver) which then project somewhat into apertures in the movement plate or carrier plate. Prior to that, before those printed circuit boards are fitted, in particular the aperture in the carrier plate is still freely accessible from the exterior so that it is possible here to insert an adjusting pin which marks the axis of the subsequent light barrier arrangement and which passes through the carrier plate to the interior of the transmission block or unit. When the transmission wheels are inserted, the apertured plate members thereof are threaded on to the adjusting pin so that the wheels are automatically correctly adjusted in relation to the angular positions of the apertured plate members with respect to the light barrier assembly when the adjusting pin is removed and the light barrier assembly is fitted instead.

One of the two elements of the transmission-type light barrier assembly which is oriented parallel to the movement axis and thus transversely with respect to the wheels, preferably the receiver which is generally larger than the transmitter, is desirably arranged together with the other electronic components of a radio-controlled timepiece electronic module on a (main) printed circuit board which is to be fixed behind the carrier plate in parallel relationship with the wheels, while the smaller light barrier assembly transmitter which is smaller and which, by virtue of its being fitted in a sunk relationship, scarcely projects beyond the thickness of the printed circuit board, is arranged on an (auxiliary) printed circuit board which is fitted at the dial side into the movement plate of the transmission block or unit which is already assembled in an operable condition. The mechanical connection of the two printed circuit boards to the transmission block or unit and the electrical connection between the two printed circuit boards are made by means of -an electrically conductive anchoring screw in axis-parallel relationship through the transmission block or unit, whereby one of the two conductor tracks of the auxiliary printed circuit board is electrically connected to one of the two conductor tracks of the main printed circuit board and thus at the same time the pair of printed circuit boards is pressed sandwich-like against the mutually oppositely disposed outside surfaces of the transmission block or unit which is disposed therebetween. By means of a pressure contact spring arranged Parallel to the anchoring screw, the respective others of the two conductor tracks of the auxiliary and main printed circuit boards are contacted with each other on the same sides of the respective printed circuit boards or by way of conducting through passages on mutually oppositely disposed sides of the respective printed circuit boards.

The present invention also relates to a method of assembling a movement of a radio-controlled timepiece, comprising the steps of:

A) positioning and adjusting pin in a carrier aperture formed in a carrier plate;

B) mounting a minutes wheel, an hours wheel, and an intermediate wheel in respective journal bearings of the carrier plate, with respective apertures of the minutes wheel, hours wheel, and intermediate wheel receiving the adjusting pin. The journal bearings define axes of rotation oriented parallel to the adjusting pin;

C) positioning a movement plate such that the minutes wheel, hours wheel, and intermediate wheel are located between the movement plate and the carrier plate;

D) connecting a screw to the carrier plate and the movement plate to draw those plates together. The fastener is parallel to the axes of rotation of the wheels;

E) removing the adjusting pin from the carrier aperture;

F) positioning a first circuit board onto the movement plate, such that an element of a light beam transmitting/receiving mechanism carried by the first circuit board enters a movement aperture of the first circuit board;

G) positioning a second circuit board onto the carrier plate, such that another element of the light beam transmitting/receiving mechanism carried by the second circuit board enters the carrier aperture and is aligned with the first element;

H) positioning a contact spring in apertures formed in the carrier plate and the movement plate, respectively; and I) drawing the first and second circuit boards together by an anchoring screw so that the contact spring electrically connects a conductor on the first circuit board with a conductor on the second circuit board.

BRIEF DESCRIPTION OF THE DRAWING

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT OF THE INVENTION

Figure 1:
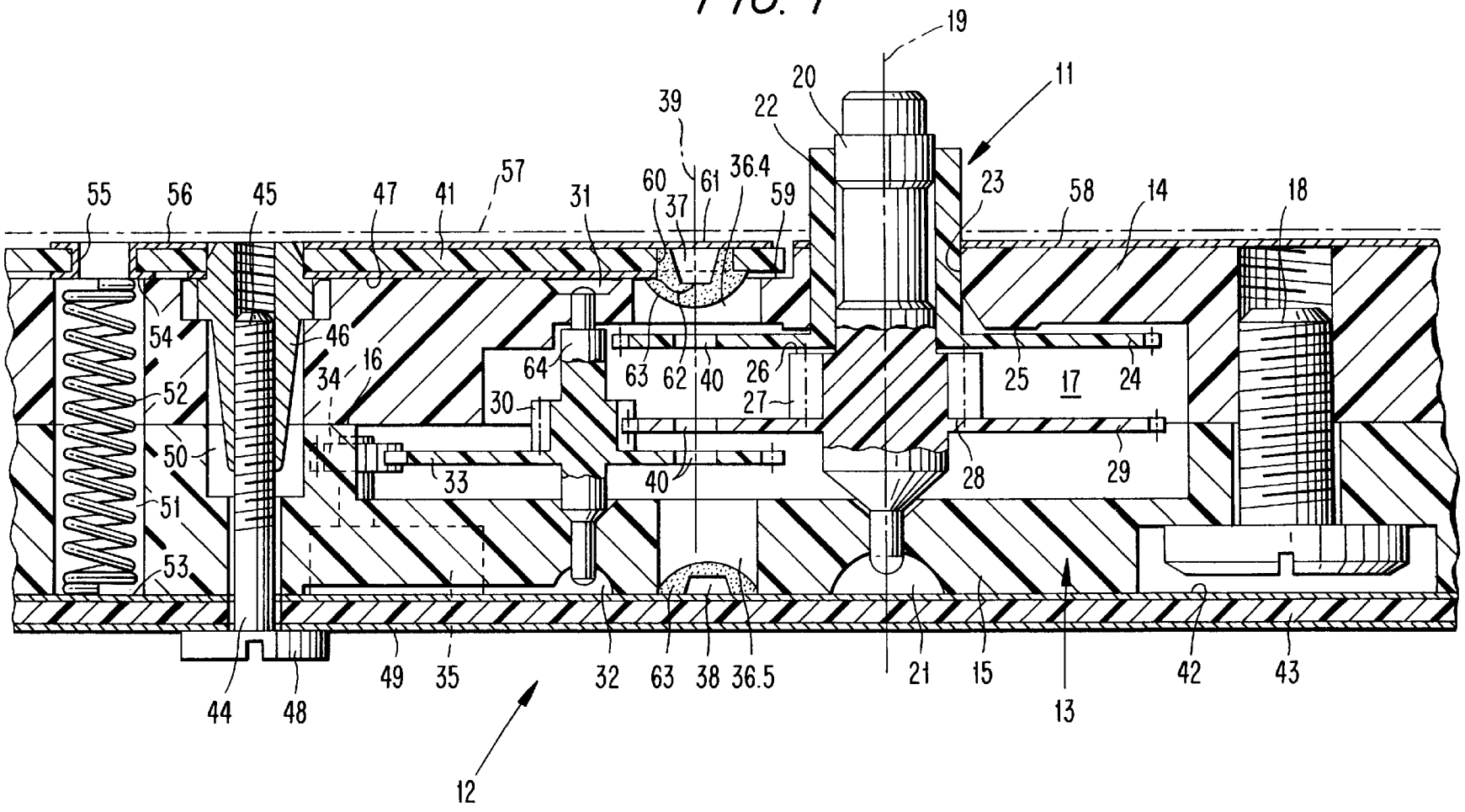
FIG. 1 depicts a broken-away view in axial longitudinal section through a radio-controlled wristwatch movement illustrating the structure of the wheel train and sensing of the angular positioning thereof by means of a light barrier assembly.

A wheel or gear train 11 of a radio-controlled wristwatch movement 12 is arranged completely operationally in the form of a two-part transmission block or unit 13 which can be enclosed in a boxlike configuration. The transmission unit 13 comprises a carrier structure which includes a profiled movement plate 14 and a carrier plate 15 which are parallel to each other and parallel to the gears or wheels. The plates 14, 15 are braced together along a junction 16, which forms a transmission space 17, by means of at least one clamping screw 18 which bridges over the junction 16 and which is sunk at the rear into the carrier plate 15, the screw being parallel to the movement axis indicated at 19. The minutes shaft 20 is mounted at one end in a journal bearing 21 in the carrier plate 15 and at an opposite end is radially guided by an hours tube 22 which concentrically surrounds the minutes shaft 20. The tube 22 projects through a central bore 23 in the movement plate 14 and is rotatably mounted therein. The hours tube 22 is axially supported within the transmission space 17 by means of the hours wheel 24 which is mounted or formed on the hours tube 22 and which is supported on the one hand against a rear side 25 of the movement plate 14 and on a other hand on the front end face 26 of a pinion 27 which is provided on the minutes shaft 20. Thus axial support for the hours tube 22 is afforded in a forward direction by the rear side 25 of the movement plate 14 and in a rearward direction by way of the minutes shaft 20 in relation to the journal bearing 21 thereof. The minutes shaft 20 is axially positioned (opposite the journal bearing 21) by means of the hours wheel 24 which can bear against the rear side 25 of the movement plate 14.

The transmission of torque from a minutes shaft pinion 27 to the hours wheel 24 is effected by means of a change wheel together with a change wheel pinion which are not illustrated in the drawing because the axis thereof, which is in parallel offset relationship with respect to the axis 19 of the hands shaft lies outside the longitudinal section plane illustrated in the drawing.

Disposed at the rearward end face 28 of the minutes shaft pinion 27 is the minutes wheel 29 which is fixedly connected to the minutes shaft 20 (or which is formed integrally therewith) and which is driven by an intermediate wheel pinion 30. The latter is mounted between front and rear journal bearings 31, 32 formed in the movement plate 14 and carrier plate 15, respectively. The pinion 30 is provided with an intermediate wheel 33 meshing with a rotor pinion 34 of a stepping motor 35 which is driven in a time-keeping mode. The motor 35 is arranged on a main printed circuit board 43 such that its pinion 34 projects into the unit 13. Apertures 36 (i.e., a front aperture 36.4 and a rear aperture 36.5), which are aligned with each other in parallel relationship with the hands shaft axis, 19 are provided in the movement plate 14 and the carrier plate 15, respectively. A radiation transmitter 37 of a detector, namely, a transmission-type light barrier assembly 39, projects from the front into an aperture of the plate 14, while a radiation receiver 38 of the light barrier assembly 39 projects from the rear into an aperture of the plate 15. A plurality of wheels project into the path of the light barrier assembly 39, namely, the intermediate wheel 33, the minutes wheel 29 and the hours wheel 24. Each of those wheels has a respective aperture 40, and those apertures can become mutually aligned with the axis of the light barrier assembly 39 during operation of the assembly 39. The apertures 40 can be holes, as illustrated, but they may alternatively, be radially outwardly opening slots formed in edges of the wheels.

The transmitter 37 is a semiconductor diode irradiating in the visible or invisible spectrum, preferably in the near infra-red spectrum, and is mechanically held by means of an auxiliary printed circuit board 41 disposed in front of the movement plate aperture 36.4, i.e., projecting somewhat into the latter. At the opposite end of the light barrier assembly 39 is the light barrier receiver 38 which is tuned to the same radiation spectrum. The receiver 38 is arranged on the front or component side 42 of the main printed circuit board 43 disposed behind the carrier plate 15, in such a way as to project into an aperture 36.5 formed in the carrier plate. Other components are arranged on the main printed circuit board 43 and wired together by way of its conductor tracks which are disposed on the surface thereof. Those components include the radio-control LED timepiece receiver, decoding and control processor, time-keeping stepping motor drive circuit and the external circuits thereof, which are also connected on the component side 42 of the main printed circuit board 43. Those components are not shown since they are outside the sectional view in the drawing; attention is directed to the arrangement thereof in our concurrently filed application (Attorney Docket No. 012150-086) entitled "Antenna For a Radio-Controlled Wristwatch" (incorporated by reference herein) where an electronic module printed circuit board (designated by numeral 13 therein) corresponds to the item which is here referred to as the main printed circuit board 43.

The mechanical connection of the two printed circuit boards 41, 43 to the transmission unit 13 and the electrical connection of the two printed circuit boards 41, 43 to each other is effected by means of an anchor screw 44 which is electrically conductive (being of metal or electrically conductively coated). By means of the screw 44 the movement plate 14 and the carrier plate 15 are drawn toward each other. The screwthreaded shank 45 of the screw 44 engages into an internally screwthreaded pillar or column member 46 which is mounted in the auxiliary printed circuit board 41 and which in the illustrated embodiment is fitted on the front lining 47 of that circuit board, for example by soldering or brazing, so that the lining 47 is electrically connected by way of the head 48 of the screw 44 to the rearward conductor track lining 49 of the main printed circuit board 43. Extending through the movement plate 14 and the carrier plate 15 in parallel relationship to, and in close proximity to, the passage 50 for the anchor screw is a guide passage 51 for a pressure contact spring 52 (preferably, as illustrated, a coil spring). The spring bears at its rear against the front lining 53 of the main printed circuit board 43, and at its front against the rear side 54 of the auxiliary printed circuit board 41, here being insulated with respect to the rearward lining 47 thereof. A metallic through passage 55 terminates in the region where the spring 52 bears against the auxiliary printed circuit board 41. In that way the electrically conductive spring 52 is connected by way of the passage 55 to the front lining 56 which is thus connected by way of the spring 52 to the front lining 53 of the main printed circuit board 43.

The auxiliary printed circuit board 41, which is disposed between the dial 57 and the front side 58 of the movement plate 14 in a recess 59 in the movement plate in parallel relationship with the plane of the wheels of the movement 12, only serves for mechanically holding and electrically connecting the front component of the light barrier assembly 39 (here a non-housed light-emitting diode serving as the radiation transmitter 37). It is desired that the module which is connected to the main printed circuit board 43 by means of the screw 44, have the minimum possible structural height in the direction of the hands shaft and movement axis 19. That is achieved in that the radiation transmitter 37 is sunk into an aperture 60 formed in the auxiliary printed circuit board 41 and rests therein on the front lining 56, or on a metal foil 61 which is connected to that lining, which bridges over the aperture 60. The transmitter 37 is mechanically and electrically connected to the circuit board 41.

The LED-chip scarcely projects beyond the rearward lining 47 of the auxiliary printed circuit board 41 and can therefore be electrically connected to the rearward lining 47 of the auxiliary printed circuit board 41 by means of an arc-shaped bond wire 62 which forms a relatively flat profile, that is to say which sticks up only a little. Accordingly a radiation-permeable casting material 63 in which the wire 62 and transmitting 37 are embedded also sticks up to only a small extent. The concentration of casting material in the area around the radiation transmitter 37, that is to say in the receiving aperture 60, reduces the amount of required casting material and required casting surface area to about a third in comparison with the casting of a chip component which is mounted flat on a surface and bonded thereto.

Figure 2:
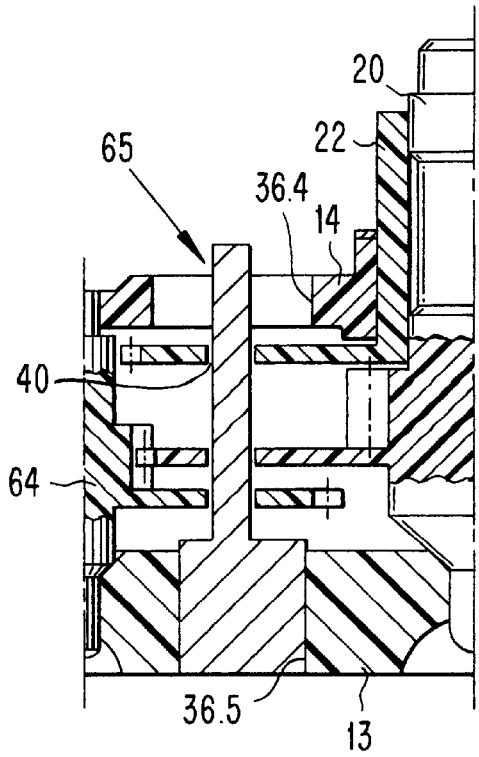
FIG. 2 is a fragmentary view of FIG. 1 depicting a step involved in the assembly of a transmission unit of the movement.
Figure 3:
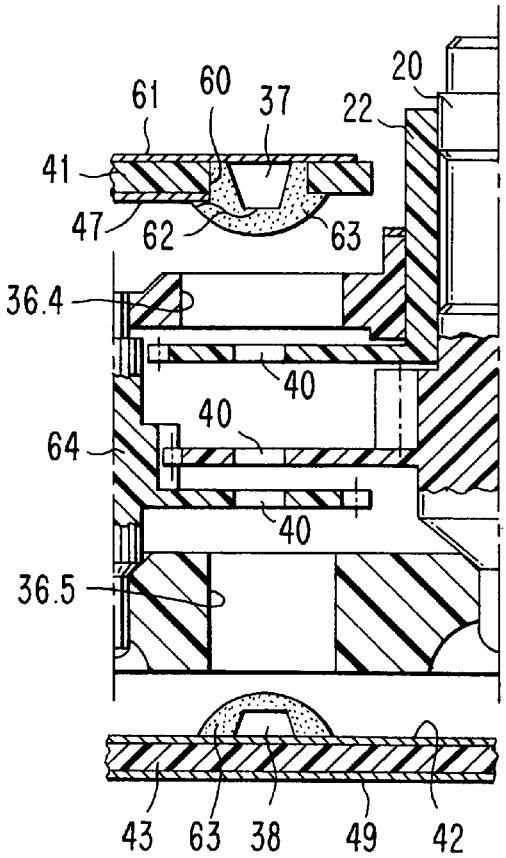
FIG. 3 is a view similar to FIG. 2 of a subsequent step in the assembly process.

The assembling of the transmission unit 13 can be effected independently of the mounting of the transmitter 37 and receiver 38 on the circuit boards 41, 43, respectively. That makes assembly of the wheel train 11 very much easier. For the assembly procedure, an adjusting pin 65 (see FIG. 2) which extends in the direction of the light barrier assembly 39 can be fitted as an assembly aid into the aperture 36.5 in the carrier plate, temporarily in place of the light barrier receiver 38. Before the movement plate 14 is fitted in position, the intermediate wheel shaft 64, the minutes shaft 20 and the hours tube 22 are fitted into the carrier plate 15, with the adjusting pin 65 extending through their apertures 40. Thus, the wheels, which are crucial in terms of the mode of operation of the light barrier assembly, are precisely positioned relative to each other when the transmission unit 13 is closed by fitting the movement plate 14 onto the carrier plate 15 and secured together by means of the screw 18. Hence, the adjusting pin 65 can now be removed from the aperture 36.5 in the carrier plate in order to allow the light barrier assembly receiver 38 to be inserted into position, when the electronic module main printed circuit board 43 is fitted in position at the rear (see FIG. 3). Simultaneously, the pinion 34 of the motor 35, which is carried by the printed circuit board 43, meshes with the wheel 33. In addition, the auxiliary printed circuit board 41 with its radiation transmitter 37 is inserted into the front recess 59 in the movement plate 14 and mechanically and electrically connected by way of the anchor screw 44 to the oppositely disposed main printed circuit board 43, due to the interposition of the contact spring 52. Without further requirements of wheel adjustment operations, the light barrier assembly 39, and the transmission unit 13 which is driven by the stepping motor 35, are now directly functional. That promotes a modular construction and as a result inexpensive, versatile use in both small-size and also large-size movements 12, especially as only the dimensions of the wheel train 11 have to be adapted to the torque conditions for the movement of the hands; then the wheel train 11, depending on the respective type of timepiece involved, can be fitted with any suitable electronic module main printed circuit board 43.

In summary, there is provided a radio-controlled timepiece movement 12 which is particularly compact but which is nonetheless easy to assemble and which is versatile in terms of use and which in particular can also be made in the sizes for a wristwatch movement. In accordance with the invention the wheel train 11 is assembled between the movement plate 14 and the carrier plate 15 and secured, by way of a screw 18, with the wheels aligned with regard to the light barrier assembly 39, thereby forming the unit 13. Then, the electronic module main printed circuit board 43 is installed on the rear of the unit 13, with the stepping motor pinion 34 engaging into the tooth arrangement of the intermediate wheel 33. The auxiliary printed circuit board 41 for the light barrier assembly transmitter 37 is installed on the front of the unit 13. The circuit boards 41, 43 are interconnected mechanically and electrically conductively by means of the anchor screw 44 passing through the unit 13, with the interposition of the contact spring 52 which is stressed between the two printed circuit boards 41, 43. The auxiliary printed circuit board 41 which is disposed under the plane of the dial 57, sticks up particularly little since the transmitter 37 is fitted on to a conducting lining 56 or foil 61 which bridges over a printed circuit board aperture 60. Electrical connection to the oppositely disposed printed circuit board lining 47 is effected by means of a bond wire 62 extending in a particularly shallow arc and with a correspondingly flat mound 63 of casting material provided. The structural height of the transmitter 37 scarcely projects beyond the thickness of the auxiliary printed circuit board 41, and the radiation-transmissive casting material 63 extends slightly into the aperture 36.4 of the movement plate 14.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A radio controlled timepiece movement comprising:

a carrier structure;

a wheel train mounted on the carrier structure and including a plurality of wheels rotatable about a first axis, the wheels having respective wheel apertures which are alignable with one another along a second axis;

a detector for detecting positions of the wheels by establishing a light beam along the second axis which passes through the wheel apertures when those apertures are aligned along the second axis, the detector including a light beam transmitting/receiving mechanism;

a printed circuit board mounted on the carrier structure and oriented perpendicular to the first axis and including first and second sides facing respectively away from and toward the wheels, a board aperture formed in the circuit board and extending from the first side to the second side to define the second axis, first and second conductors mounted on the first and second sides, respectively, the first conductor covering a respective end of the board aperture, an element of the transmitting/receiving mechanism being disposed in the board aperture and mounted on a portion of the first conductor covering the board aperture; and a wire extending from the element to the second conductor.

2. The movement according to claim 1 wherein the wheels include an hours wheel and a minutes wheel.

3. The movement according to claim 1 wherein the element and the wire are embedded in a radiation-permeable material which fills the board aperture and projects therebeyond.

4. The movement according to claim 3 wherein the element comprises a light beam transmitter, and the circuit board comprises a first circuit board, the movement further comprising a second circuit board mounted on the carrier structure parallel to the first circuit board and spaced therefrom, whereby the wheels are disposed between the first and second circuit boards, the transmitting receiving mechanism further including a receiver mounted on the second circuit board in opposite relationship to the transmitter and lying on the second axis, the receiver projecting into a carrier aperture formed in the carrier structure.

5. The movement according to claim 1 wherein the element comprises a light beam transmitter, and the circuit board comprises a first circuit board, the movement further comprising a second circuit board mounted on the carrier structure parallel to the first circuit board and spaced therefrom, whereby the wheels are disposed between the first and second circuit boards, the transmitting receiving mechanism further including a receiver mounted on the second circuit board in opposite relationship to the transmitter and lying on the second axis, the receiver projecting into a carrier aperture formed in the carrier structure.

6. The movement according to claim 4 wherein the first and second circuit boards are drawn toward one another and against respective sides of the carrier structure by an anchor screw.

7. The movement according to claim 6 wherein the anchor screw engages conductors on the first and second circuit boards, respectively, to electrically interconnect those conductors.

8. The movement according to claim 6 further including a contact spring extending through the carrier structure parallel to the anchor screw and engaging conductors on the first and second circuit boards, respectively, to electrically interconnect those conductors.

9. The movement according to claim 8 and second conductors are interconnected by a conductive passage formed in the first circuit board.

10. The movement according to claim 7 further including an electrically conductive pillar mounted in an opening of the circuit boards and electrically connected to a conductor thereof, the anchor screw being received in the pillar.

11. The movement according to claim 4 further including a stepping motor mounted on the second circuit board and operably engaging the wheel train.

12. A method of assembling a movement of a radio-controlled timepiece, comprising the steps of:

A) positioning an adjusting pin in a carrier aperture formed in a carrier plate;

B) mounting a minutes wheel, an hours wheel and an intermediate wheel in respective journal bearings of the carrier plate, with respective apertures of the minutes wheel, hours wheel and intermediate wheel receiving the adjusting pin, the journal bearings defining axes of rotation oriented parallel to the adjusting pin;

C) positioning a movement plate such that the minutes wheel, hours wheel, and intermediate wheel are located between the movement plate and the carrier plate;

D) connecting a fastener to the carrier plate and the movement plate to draw those plates together, the fastener being parallel to the axes of rotation of the wheels;

E) removing the adjusting pin from the carrier aperture;

F) positioning a first circuit board onto the movement plate, such that an element of a light beam transmitting/receiving mechanism carried by the first circuit board enters a movement aperture of the first circuit board;

G) positioning a second circuit board onto the carrier plate, such that another element of the light beam transmitting/receiving mechanism carried by the second circuit board enters the carrier aperture and is aligned with the first element;

H) positioning a contact spring in apertures formed in the carrier plate and the movement plate, respectively; and I) drawing the first and second circuit boards together by an anchor screw so that the contact spring electrically connects a conductor on the first circuit board with a conductor on the second circuit board.

* * * * *